US006128912A

United States Patent [19]

Wetzel

[11] Patent Number: 6,128,912

[45] **Date of Patent: *Oct. 10, 2000**

[54] FLORAL DISPLAY CASE FOR DIRECTLY EMPLOYING WET-PACK CONTAINERS

[75] Inventor: Michael L. Wetzel, Skaneateles, N.Y.

[73] Assignee: Floratech Industries, Inc., Syracuse, N.Y.

[ * ] Notice: This patent is subject to a terminal disclaimer.

[21] Appl. No.: 09/232,597

[22] Filed: Jan. 19, 1999

Related U.S. Application Data

[63] Continuation-in-part of application No. 08/955,224, Oct. 22, 1997, Pat. No. 5,860,289.

[51] Int. Cl.[7] ..... A47F 3/04

[52] U.S. Cl. ..... 62/256

[58] Field of Search ..... 62/255, 256; 454/193

[56] References Cited

U.S. PATENT DOCUMENTS

| | | | |
|---|---|---|---|
| D. 400,030 | 10/1998 | Wetzel | D6/474 |
| 4,458,501 | 7/1984 | Kooy | 62/256 |
| 4,608,776 | 9/1986 | Kooy | 47/58 |
| 4,608,835 | 9/1986 | Kooy | 62/255 |
| 4,680,942 | 7/1987 | Kooy | 62/256 |
| 4,953,363 | 9/1990 | Primozic | 62/255 |
| 5,060,799 | 10/1991 | De Pagter | 206/223 |
| 5,475,987 | 12/1995 | McGovern | 62/256 |
| 5,502,979 | 4/1996 | Renard | 62/256 |
| 5,564,225 | 10/1996 | Quiding et al. | 47/58 |
| 5,860,289 | 1/1999 | Wetzel | 62/255 |

*Primary Examiner*—William E. Tapolcai
*Attorney, Agent, or Firm*—Trapani & Molldrem

[57] ABSTRACT

A refrigerated open display case has receptacles or holders for directly receiving wet-pack shipping containers, so that flowers do not need to be repacked into vases. A laminar flow of chilled air over the flowers establishes a laminar flow boundary layer with the warmer ambient air. An array of perforations serve as chilled air supply openings on the vertical riser walls, and chilled air is discharged in a laminar flow. A return air intake grille extends across the cabinet below the front of the lowermost shelf, in an undercut transverse recess. The front part of each shelf member has a chamfer or downward slope. The receptacles for the wet-pack containers can include cutouts that extend onto the chamfered front parts of the shelves. The forward wall of the container is exposed above the chamfer, which facilitates insertion and removal. Inside the cabinet, the coldest air leaving the evaporator coil passes in contact with the underside of the shelf members and with the containers. Alternatively, the containers can be suspended on hangers supported on the perforated vertical walls.

7 Claims, 7 Drawing Sheets

FLORAL DISPLAY CASE FOR DIRECTLY EMPLOYING WET-PACK CONTAINERS

This is a continuation-in-part of my co-pending U.S. pat. application Ser. No. 08/955,224, filed Oct. 22, 1997, now U.S. Pat. No. 5,860,289.

BACKGROUND OF THE INVENTION

The invention concerns a refrigerated display case or merchandiser for cut flowers or other merchandise. One aspect of the invention is concerned with a floral display case which achieves laminar flow of cooling air over the cut flowers in the case, and which can be configured either as an open display case, with an open top, open front, and low profile, or as a traditional cabinet type display with a top or ceiling covering the top, and perhaps containing lighting fixtures. Either configuration achieves improved presentation, as well as improved preservation of the flowers or other merchandise. Another aspect of the invention is concerned with a floral merchandiser that has receptacles especially adapted to receive palletizable wet-pack containers, so that these can be loaded directly into the merchandiser for display and without unnecessary repackaging or other handling of the flowers or other delicate botanicals.

Refrigerated display cases are frequently used in markets for presenting merchandise that must be kept cold, such as dairy products. In the case of floral merchandisers or display cabinets, there have been a number of open refrigerated display cases proposed, and several of these appear in U.S. Pats. Nos. 4,608,835; 4,608,776 and 4,680,942. In each case, the cabinet contains refrigeration equipment for chilling air that circulates through, and there is an open display portion, in which vases or containers are seated in openings or receptacles in shelves. In each case, there is a top wall over the shelves of flowers, and refrigerated air flow is directed downwards from a top grating in the top wall down to a return grating inside the cabinet, at the inner wall of the front of the cabinet. The downward flow of air requires that the cold air be pumped or blown up to the top wall. The need for this top wall increases the height and weight of the display unit, and also creates a somewhat less inviting presentation to the customer.

Also, in the display cases of the prior art, the return air intake grating, being positioned at the base and at the inside of the cabinet, collects flower petals, dead leaves and other debris, which can affect the operation of the unit, and which require special cleaning. Some of these drop through and collect in the drain pan below the evaporator coil. In addition, positioning the return intake inside the cabinet makes it impossible for the unit to pick up chilled air that spills out the open front, thereby limiting the recirculation and limiting efficiency of the unit. This also increases the amount of warm air that is sucked into the unit.

Recently, a wet-packaging system for packaging and shipping cut flowers from grower to florist has made it possible to ship flowers upright with the stems in water. This system permits the flowers to be shipped with a minimum of shock and without risk of drying out. Also, some floral varieties are rather geotropic, and have to be shipped and stored vertically to prevent their stems from developing bends. The containers for this can be stacked on a pallet or in a crate, and sent by truck or air freight without leakage of the liquid from the containers. One such system is described, for example, in U.S. Pat. No. 5,060,799. The bouquets of cut flowers are placed upright into a plastic container, with an amount of water, plus other nutrients. A corrugated sleeve is placed around upper parts of the flowers, and then a cover is placed on the sleeve. Another container can be placed on top of this, so that it is possible to stack several layers of these wet packs on a single pallet. In addition, the plastic container is given a geometry to maximize the density of containers on a pallet, for example, rectangular and about 10 inches by 12 inches. Once the pallet of floral containers reaches the florist, the containers can be removed from the pallet, and the flowers can be placed in a suitable merchandiser or other display unit for retailing. In practice, this means removing the flowers or bouquets from the shipping container and placing them in vases in the merchandiser. In theory, it is possible to use the shipping containers directly, i.e., for the flowers to be displayed at retail in the shipping container without transfer to a bucket or vase. However, because of the size and shape of the containers, this means placing the container directly on the floor of the shop, or on a shelf. Present day floral merchandisers are not adapted with sockets, receptacles, or holders for receiving the wet shipping containers directly.

OBJECTS AND SUMMARY OF THE INVENTION

Accordingly, it is an object of this invention to provide a refrigerated floral display case that avoids the drawbacks of the prior art, and which creates an open, inviting presentation of the flowers or other merchandise to customers.

It is another object of this invention to provide a floral merchandiser that is adapted to receive the containers of a palletizable wet-pack floral shipping system, without having to repackage the cut flowers into vases, buckets, or other containers, thus minimizing the amount of handling of the cut flowers, and yet presenting the flowers attractively in the merchandiser.

It is another object to provide a refrigerated floral display case in which chilled air proceeds in a laminar flow from behind the flowers, then downwards, thereby gently bathing the flowers in cool air.

It is yet another object to provide a refrigerated floral display case in which the coldest air passes over the containers first.

It is a further object of the invention to provide a laminar flow refrigerated display case which present the cut flowers in optimal density, using a side-by side arrangement of the wet-pack floral containers.

It is a still further object to provide a display case in which petals, leaves, plant parts, or other debris fall harmlessly outside the cabinet and do not fall into the cabinet nor block the air flow through the return grille.

According to an aspect of this invention, a refrigerated open floral display case produces a laminar flow of chilled air over the flowers displayed therein, and establishes a laminar flow boundary layer. The case has a cabinet having a back, sides and an open front display portion, the front display portion including a plurality (e.g., two or more) of horizontal shelf members arranged in parallel staggered stair-step fashion. Vertical riser walls are disposed respectively behind the horizontal shelf members and connect between successive ones of said shelf members.

Refrigeration equipment within the cabinet produces a continuous, recirculating laminar flow of chilled air over the shelf members. There is a return air intake grille disposed across the cabinet below the front of a lowermost one of the shelf members, and on the outer side of the cabinet. The refrigeration equipment has a heat exchanger, i.e., an evaporator coil, that chills the air that enters said return air intake, and a fan or blower moves the air in a channel within the cabinet to chilled air supply openings arranged across each of the vertical riser walls, so that the chilled air is discharged in a laminar flow path over said shelves towards said return air intake. The air then is drawn in through the return air grille, and is recirculated through the evaporator coil and the supply openings.

The return air intake is formed as a recess extending transversely below the front of the lowermost shelf member and the return air grille is disposed in an undercut transverse wall of this recess. The front part of the lowermost shelf member can have a chamfer or downward slope, so that debris that falls on it drops to the floor in the front of the cabinet, where it can be routinely swept up. The recess below this chamfer can likewise have a slanting lower wall that meets the undercut transverse wall. This also ensures that any debris that is blown towards the return air intake grill drops to the floor in front of the cabinet, and does not fall into the unit.

Inside the cabinet, the chilled air proceeds from the evaporator coil through a cold air tunnel defined between the shelf members and a partition disposed beneath the shelf members. Thus the coldest air, that is, the air leaving the evaporator coil, passes in contact with the underside of the shelf members, so these shelf members are also kept chilled. This ensures that the air flow leaving the supply openings will hug the surfaces of the shelves, and flow non-turbulently past the flowers.

Floral containers, sometimes referred to as vases, are positioned in open receptacles in the shelves, with the bottoms of the vases or containers projecting down into the cold air tunnel. Thus the cold air flow keeps the containers, and water contained in them, cool to prolong flower freshness. The water in the vases or containers stays cold, and acts as a heat sink. This maintains the cold air flow when the refrigeration ceases, for example, when the unit goes into a defrost cycle. Thus this arrangement eliminates significant temperature swings in the air flow over the flowers, produce, or other merchandise.

Preferably, the vertical riser walls each have a multiplicity of chilled air supply openings evenly distributed on them in a two-dimensional array, so that the air leaving the supply openings creates a gentle, laminar flow.

On one or both sides of the cabinet there can be side walls, which can be glass or clear plastic, or can be clear, frosted, opaque or mirrored. These side walls may have a curved edge or a shape that approximates a quarter of an ellipse, and conforms with the boundary layer of the laminar flow from the uppermost supply openings into the return intake. Alternatively, the walls can have straight sides, and can have a ceiling or top containing lighting fixtures.

The refrigerated merchandise display case of this invention can maintain a low-velocity, laminar flow within the display case to protect and preserve products that are sensitive to temperature, humidity, and air velocity. Flowers will degenerate more rapidly if exposed to high air flow, even if the temperature and humidity are correct, due to stress on the fibers of the petals, leaves, and stems from the motion caused by the air flow. Dehydration is also accelerated by high air flow. Many other fresh and fresh-cut products experience this same problem. That is, the merchandise display case of this invention provides improved protection for products subject to dehydration, such as cut flowers, which can experience weakness of stems and petals. Other sensitive products, such as fruit, cheeses, or sliced food products, can enjoy improved shelf life from the arrangement of this invention.

The shelves of the display case are preferably arranged in step fashion, with openings cut in them so that the standard wet-pack floral containers can be removed from a pallet and dropped directly into the associated opening. In this case, the shelves can have a chamfered front, so that the container is exposed more at the front. The container handle on this side is thus easily accessible, and permits easy removal of the container when the flowers have all been sold. The cutout hand hold at the rear of the container is then partly below the shelf, and permits some refrigerated air to enter the container, bathing the stems in cool, moist air. The shelves can be easily changed out by the florist using simple tools to adapt to different sizes of these containers.

In an alternative embodiment, a rack or holder can be installed on a perforated wall of the unit, and the wet-pack containers can be suspended from the wall in such racks or holders.

The above and many other objects, features, and advantages of this invention will become apparent from the ensuing detailed description of a preferred embodiment, when should be read in conjunction with the accompanying Drawing.

DETAILED DESCRIPTION OF THE PREFERRED EMBODIMENT

Figure 1:
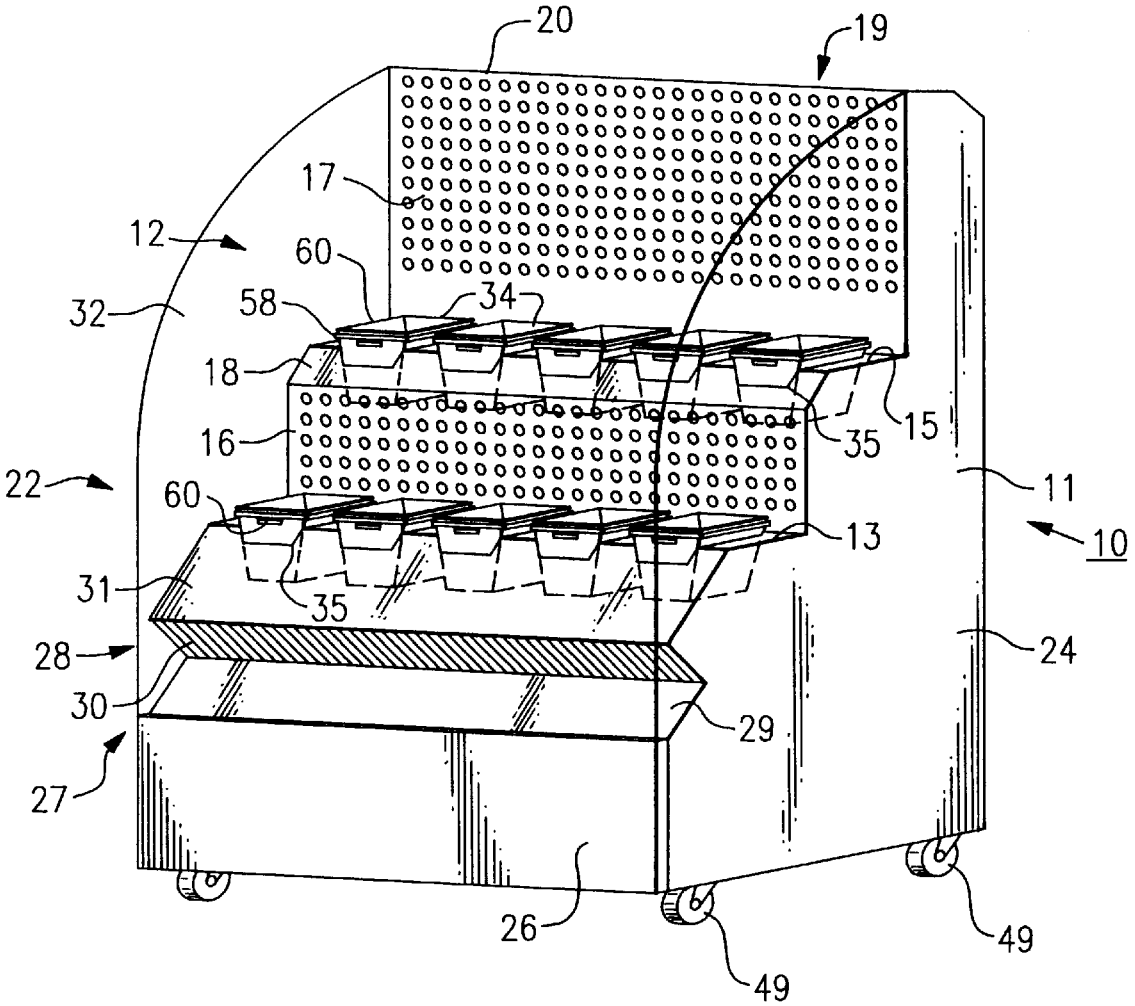
FIG. 1 is a perspective view of a refrigerated floral display unit according to one embodiment of this invention.
Figure 2:
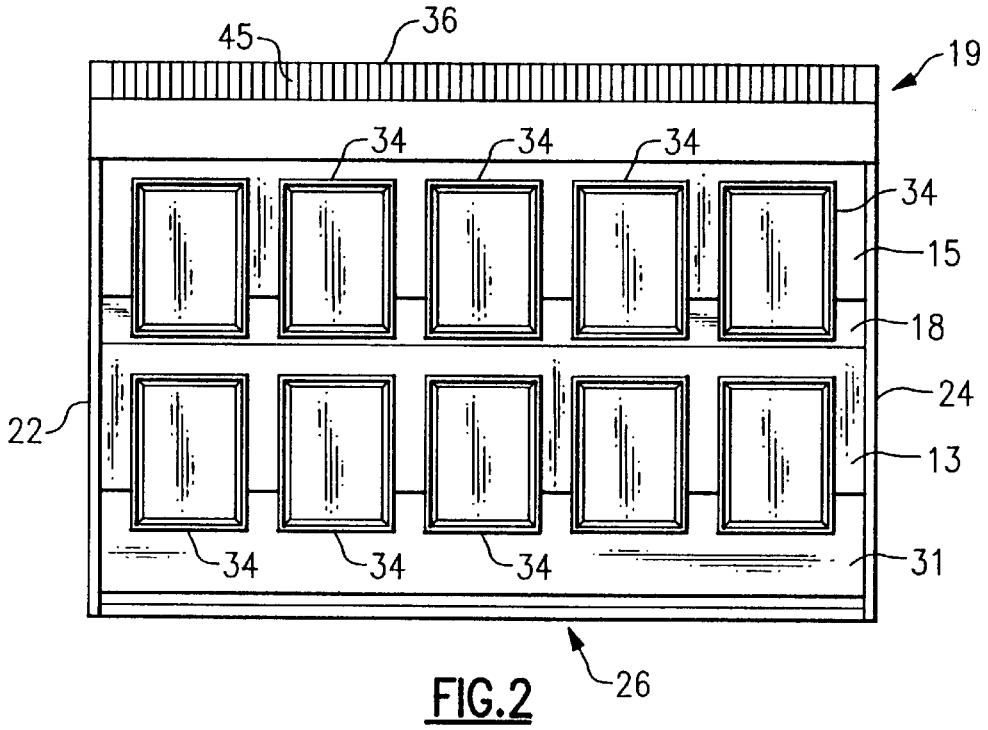
FIG. 2 is a to plan view of the unit of this embodiment.
Figure 3:
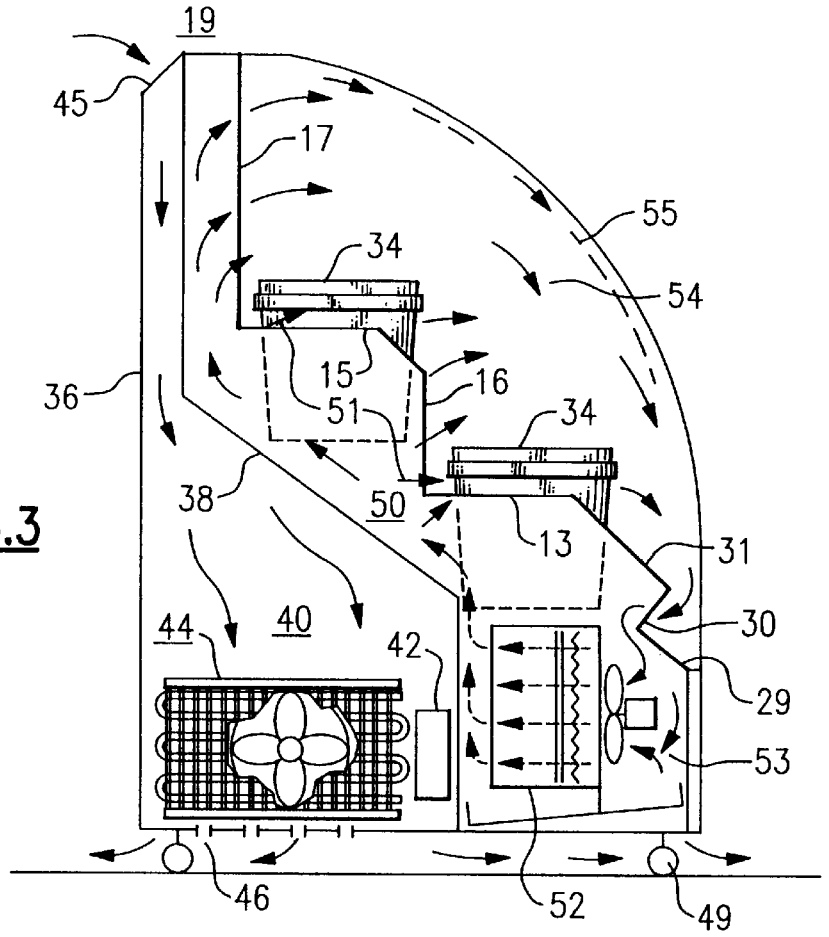
FIG. 3 is a cross-sectional view of the unit of this embodiment.

With reference to the Drawing, and initially to FIG. 1 to 3, a floral display unit 10 or refrigerated merchandiser holds flowers (or other merchandise) for presentation to customers, and gently bathes the flowers with a flow of cool air. This keeps the cut flowers as fresh as possible. The floral display unit has an open front and open top to provide customers a better view of the flowers and improved access. This low-profile feature also improves store security, allowing store personnel to see over the unit. The open top creates a lower profile for the unit than would be possible otherwise, and permits natural or ambient room lighting to fall on the flowers. The open top also permits tall cut floral arrangements or other tall items to project above the top of the unit, if desired. For cut flowers, too low an air flow fails to keep the flowers covered in cool air, but too high an air flow creates turbulence, which can induce warm air from outside into the display case. High, turbulent flow can result in a high evaporation rate, which dries the flowers out.

The merchandiser has a case or cabinet 11 with a front open display portion 12, here shown with shelves or shelf members arranged in a staggered or stair-step fashion, comprising a lower horizontal shelf 13 and an upper shelf 15. There is a vertical riser wall 16 behind the shelf 13 and rising to the front of the shelf 15, and a vertical riser wall 17 from the rear of the shelf 15 to the top 19 of the cabinet 11. In other embodiments, there can be more (or fewer) horizontal shelves. In each of the vertical riser walls 16, 17 there are a multiplicity of perforations 20 which serve as cold air supply openings. These perforations 20 are arranged in a two-dimensional grid or array on the vertical surface of each of the riser walls. The quantity and size of these perforations is specifically calculated to assure a laminar air flow. The cold air flows non-turbulently out of the perforations and forward through the open displayed portion 12 of the cabinet 11.

The cabinet also has left and right side walls 22 and 24, and a front wall 26. In the front wall 26 there is a transverse recess 27 just below the lower shelf 13, with an undercut upper wall 28 and a downwardly slanted lower wall 29 that meets the undercut upper wall. A return air intake grille 30 is situated in the undercut wall 28. There is also a downwardly slanted, or chamfered front surface 31 at the front of the lower shelf 13. The upper shelf 15 has a chamfered front surface 18 similar to the wall 31.

At the side walls there are optional glass sides 32, which define left and right sides of the open display portion 12 of the unit. The sides 32 here have a curved edge that generally follows the streamline of the boundary layer between the cold air and the warmer ambient air. This curved edge generally approximates the shape of a quarter ellipse, but the actual shape can vary with the dimensions of the display portion 12. These sides can be clear, frosted, opaque, or may be mirrored, as desired. Also, by removing the sides 32, it is possible to butt two or more of these units 10 side by side to create a multiple-width floral display merchandiser.

Figure 4:
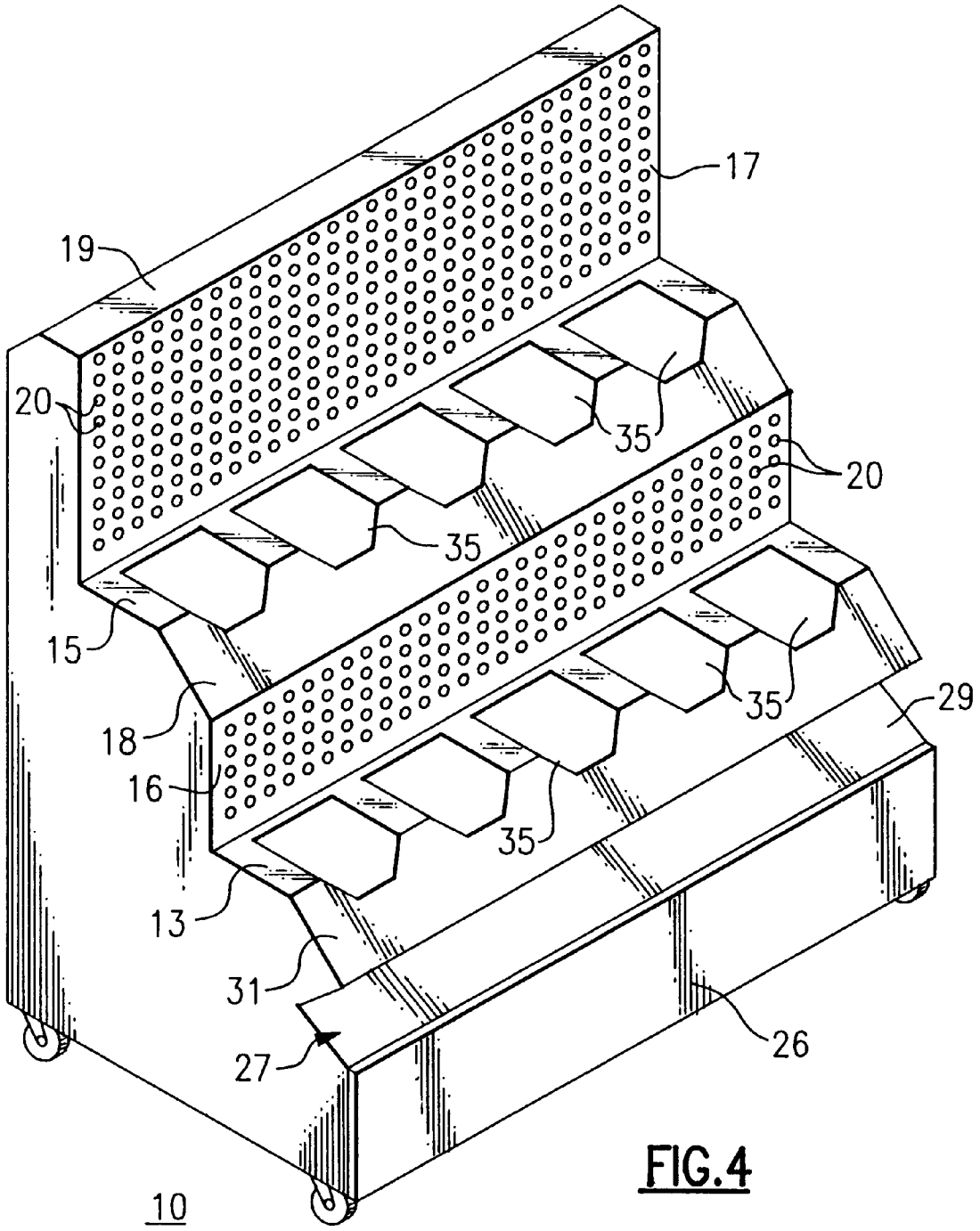
FIG. 4 is a perspective view of this embodiment, without the floral containers.

As shown in FIGS. 2 and 3, there are floral containers 34 for cut flowers, and these fit into oblong receptacles 35 or cutouts formed in the shelves. The receptacles or cutouts are shown in FIG. 4. The containers 34 contain cut flowers that have been prepackaged by the grower. Additional flowers or bouquets can be placed in these containers 34, and water is maintained in them to provide moisture for their stems.

As shown in FIG. 4, the cutouts or receptacles 35 extend from the flat part of the shelves onto the chamfered or downward sloping parts. This exposes some of the end wall of the container 34, permitting access to one hand hold as shown in FIG. 1. This facilitates insertion and removal of the containers 34, which can be somewhat heavy if filled with water. The positioning of the front part of the cutout receptacle on the downward sloping chamfer also makes it possible to remove the container by rocking it slightly forward before lifting it, giving the florist a better grip and allowing the container to be pulled forward, instead of just being lifted vertically upwards.

At the same time, the hand hold cutout at the rear side of the container may be positioned below or partly below the level of the shelf, and this permits some of the chilled air to circulate through the hand hold, as shown by airflow arrows 51 in FIG. 3.

The internal construction and operation of the refrigerated display unit 10 of this embodiment can be explained with reference to the cross-sectional view of FIG. 3. Here a back wall 36 extends up to the top of the unit, and there is an insulated internal partition 38 that divides the interior space into a compressor equipment compartment 40 and a cold air pathway 50.

In the compartment 40 is located a refrigeration compressor 42 and a blower, which moves air downwards through a condenser coil 44. A condenser air intake grille 45 is located along a top edge of the cabinet, and here is angled downwards or chamfered. This allows the unit 10 to be pushed with the back 36 flush against a wall without obstructing condenser air flow, even if merchandise or other items are laid on the top 19 of the unit. The condenser air flows downwards to the compartment 40, and warm air from the condenser coil 44 is discharged out a vent 46 at the bottom of the unit 10. This disperses the warm exhaust air onto the floor, and does not disturb shoppers. Also shown on the bottom of the unit are wheels or casters 49 which permit the unit 10 to be easily positioned in the store. These wheels 49 also create a small clearance for the dispersal of the warm air exhausted from the condenser coil 44.

The cold air pathway 50 is defined between the partition 38 and the steps or shelves 13, 15 and the riser walls 16, 17. There is a layer of insulating material disposed on the partition 38. An evaporator coil or cooling coil 52 is positioned below the lowermost shelf 13 and adjacent the return air intake grille 30, and an evaporator fan 53 induces an air flow into the grille 30 and then moves the air through the evaporator coil 52. The evaporator coil 52 chills the air, which then proceeds upwards along the cold air pathway 50. The cold air then is discharged out the supply openings or perforations 20 on the vertical riser walls, and flows non-turbulently, generally as shown in arrows in FIG. 3, along a laminar flow path 54. A cold-air, warm-air interface, or boundary layer 55 is created at the outer edge of the laminar flow 54, which generally follows the quarter-ellipse edge profile of the glass sides 32 in this embodiment. The laminar flow path proceeds generally forward from the perforations 20, and then downwards in a gently curved path back to the return air intake grille 30.

In this embodiment, the coldest air, that is, the air leaving the evaporator, contacts the undersides of the shelves 13, 15, and the containers 34 filled with water, so that the shelves and the containers are kept chilled below ambient temperature and at the lowest temperature of the system. The cold air emanating from the array of perforations 20 therefore hugs the shelves and vases as it proceeds. The cold flow of air remains separated from the warmer ancient air, and maintains its laminar state until it reaches the return air intake grille 30. The cold air in the pathway 50 is also in contact with the lower part of the containers 34 which project down through the openings 35 beneath the shelves 13, 15. This keeps the water cool within the containers 34, thereby helping to preserve the freshness of the flowers. The cold water acts as a thermal mass to keep the air temperature constant, even during the defrost cycle.

The evaporator coil is oversized, so as to minimize moisture removal, keeping the relative humidity relatively high. The refrigeration equipment is of a high-efficiency design, and automatically evaporates condensation using internally generated hot gas, and without need for external heaters or drains. The refrigeration equipment is thermostatically controlled, with automatic defrost cycle.

The position of the return air intake grille 30 at the front of the cabinet 11 beneath the lower shelf 13 ensures that the cold air stays within the boundary layer 55, and that the cold air is all returned to the evaporator coil 52. This prevents the cold air from spilling out of the case and being lost, which would cause warm air to be sucked in to replace it. Also, the downwardly sloped shape of the walls 29 and 31, with the grille 30 being positioned on the undercut wall 28, ensures that any spillage or debris falls away from the return air intake and onto the floor of the store or shop, where it can be easily cleaned away. No debris or foreign matter lands in the evaporator drain pan.

While not shown in this embodiment, the unit 10 is typically provided with plugs or inserts for the openings 35 in the shelves so that some of the containers 34 can be removed, and the shelves (or portions of them) can be used for display of items other than cut flowers. The floral display unit of this embodiment is of modular design, and can be combined with other display units, either refrigerated or non-refrigerated. The unit 10 achieves a high merchandise display capacity with a smaller footprint than other refrigerated floral merchandisers. The cabinet 11 may have exterior slatwall on the sides or back, permitting shelving to be added, if desired. Optionally, a remote refrigeration system can be employed, or a different type of refrigeration system can be employed such as chilled water, or the unit can be configured with another similar unit in a master-slave or client-server configuration. The unit 10 can be provided in any of a variety of sizes, with some typical configurations being ten containers (five containers per shelf, and two shelves) and fourteen containers.

Of course, the refrigerated display units of this invention are not limited to merchandising flowers. These can be used or configured for other products, such as fresh produce, cheeses, and other perishables. By configuring the unit for lower or freezing temperatures, the display units can be used for frozen products, such as frozen desserts.

It is also possible to adapt the refrigerated display unit for filtration of the airflow, e.g., by incorporating a HEPA filter, as a means for reducing microbial airborne contamination of foodstuffs and fresh cut products. This reduces contamination from bacteria, mold spores, or other airborne contaminants. The laminar airflow and its boundary layer serve to keep the recirculating air separated from the ambient air, and thereby allow the recirculating air to be HEPA filtered. This keeps the merchandise in a very clean, contamination-free environment, while presenting the merchandise in an attractive open and pleasantly displayed arrangement.

Figure 5:
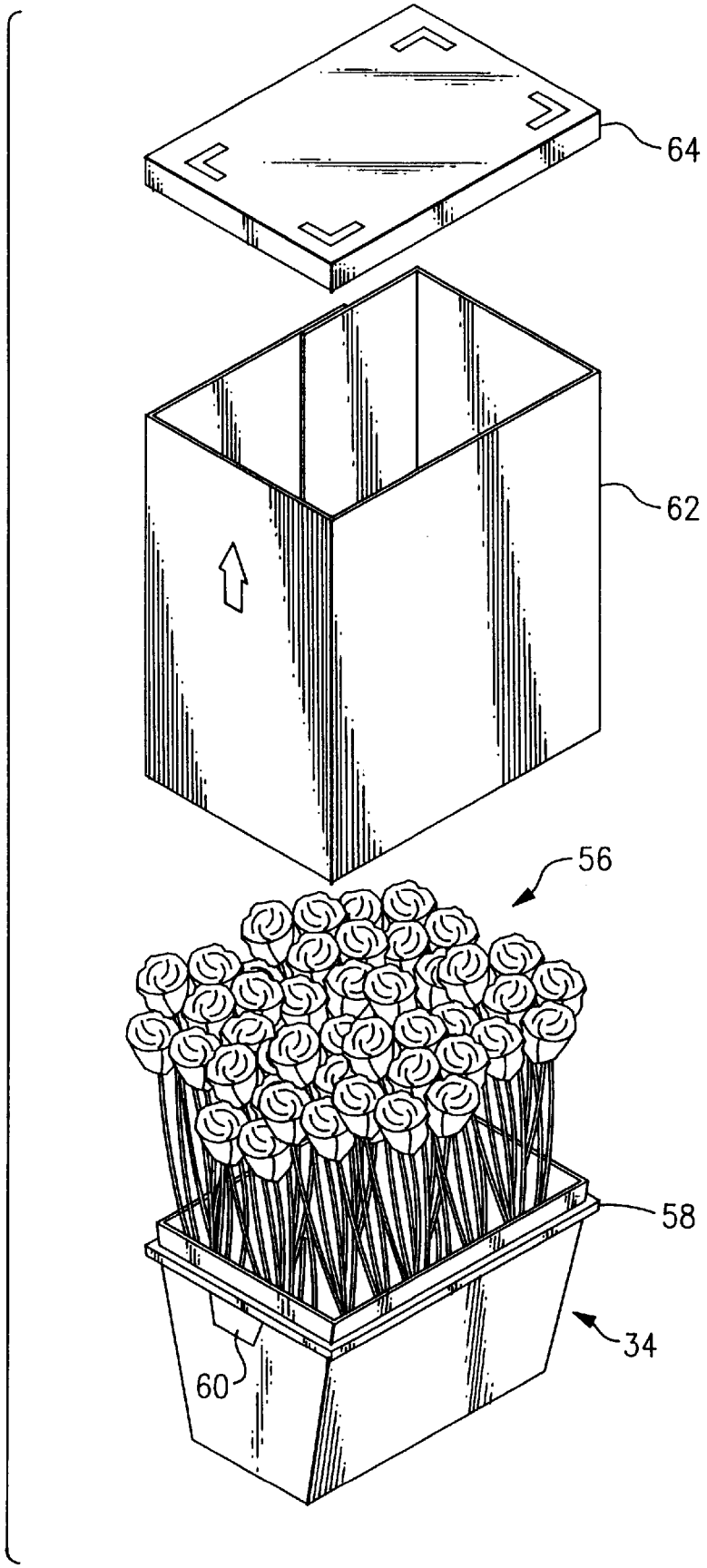
FIG. 5 is an assembly view of the wet-pack container system.

A wet-pack shipping arrangement, such as described in U.S. Pat. No. 5,060,799, is shown in FIG. 5. Here a number of bouquets of flowers 56 are packed into the container 34, which is made of a waterproof plastic material. The container has tapered walls, and a ring-type flange 58 near its top, to facilitate stacking or nesting of the empty containers. A cutout hand hold 60 is formed in each of the narrow sides of the container. A sleeve 62 is formed of corrugated board or similar material, and seats onto the flange ring 58 to protect the stems and blossoms of the bouquets of flowers 56. A lid 64 fits onto the top of the sleeve 62. The lid can have structure to permit nesting of a wet-pack on top of it. The container 34, sleeve 62, and lid 64 are held together by strapping or tape, and these packages are placed in layers on a pallet for shipping. This permits the grower to ship the flowers rapidly, i.e., by air freight, with the flowers in an upright position and with moisture and nutrients provided to the stems. The retailer simply removes the packages from the pallet, removes the lid 64 and sleeve 62, and then can drop the container directly into the receptacle 35 in the display unit 10. This minimizes the amount of shock to the flowers, as there is no repacking into vases or other containers, and in addition the same nutrient solution that is used for shipping is used for retail.

Figure 6:
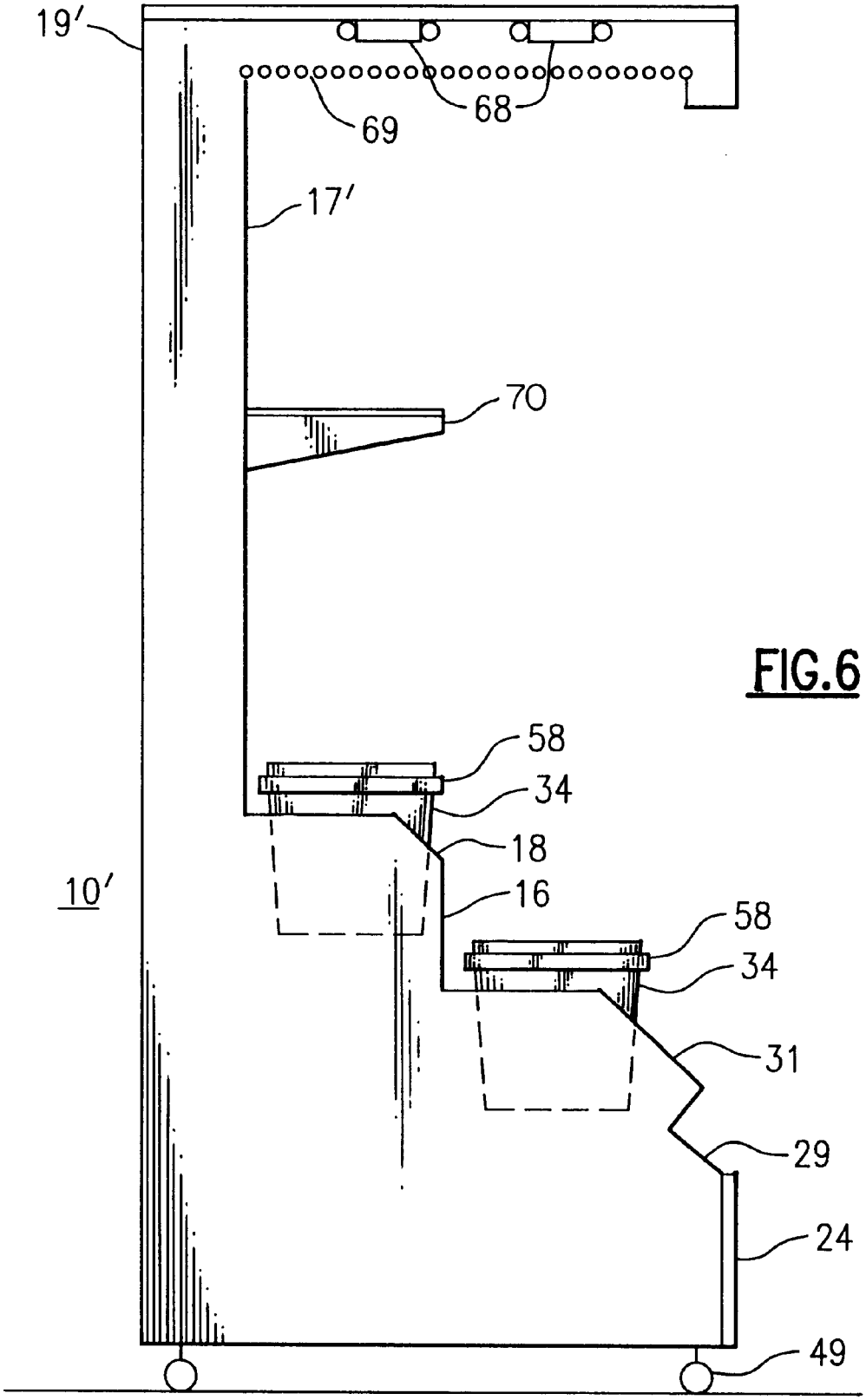
FIG. 6 is a side elevation of another embodiment of this invention.

An alternative embodiment of this invention is shown in FIG. 6, in which elements that are common to the embodiment of FIGS. 1 to 4 are identified with the same reference numbers, and a detailed description can be omitted. Those elements that are modified from the other embodiment are identified with primed reference numbers. In this embodiment, the back wall 10' extends upward above the level of the first embodiment, and at its top 19' supports a top wall 66 which can contain lighting fixtures 68 and a grille 69. The riser wall 17' in this embodiment supports a shelf 70. Otherwise, the function and operation is similar to that of the first embodiment, and holds two rows of containers 34 in the same manner. Side walls may be present, although not shown here. Also, if desired, glass front doors may be present.

Figure 8:
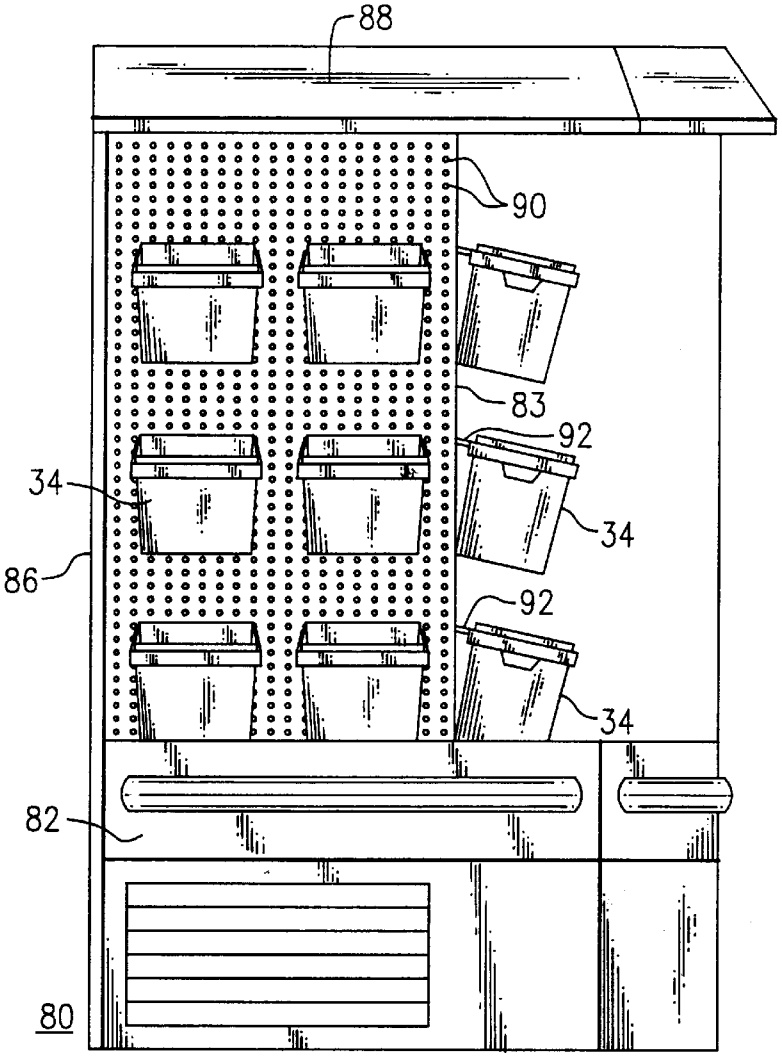
FIGS. 7 and 8 are side and end elevations of a floral display unit according to another embodiment of this invention.
Figure 7:
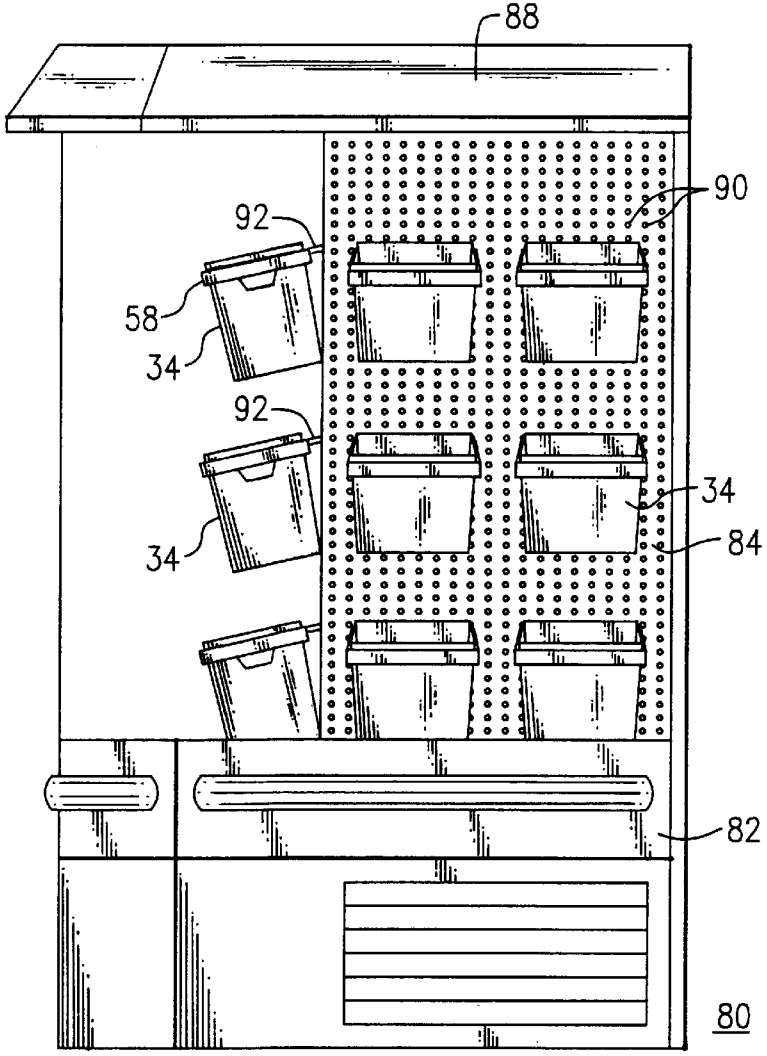
Figure 9:
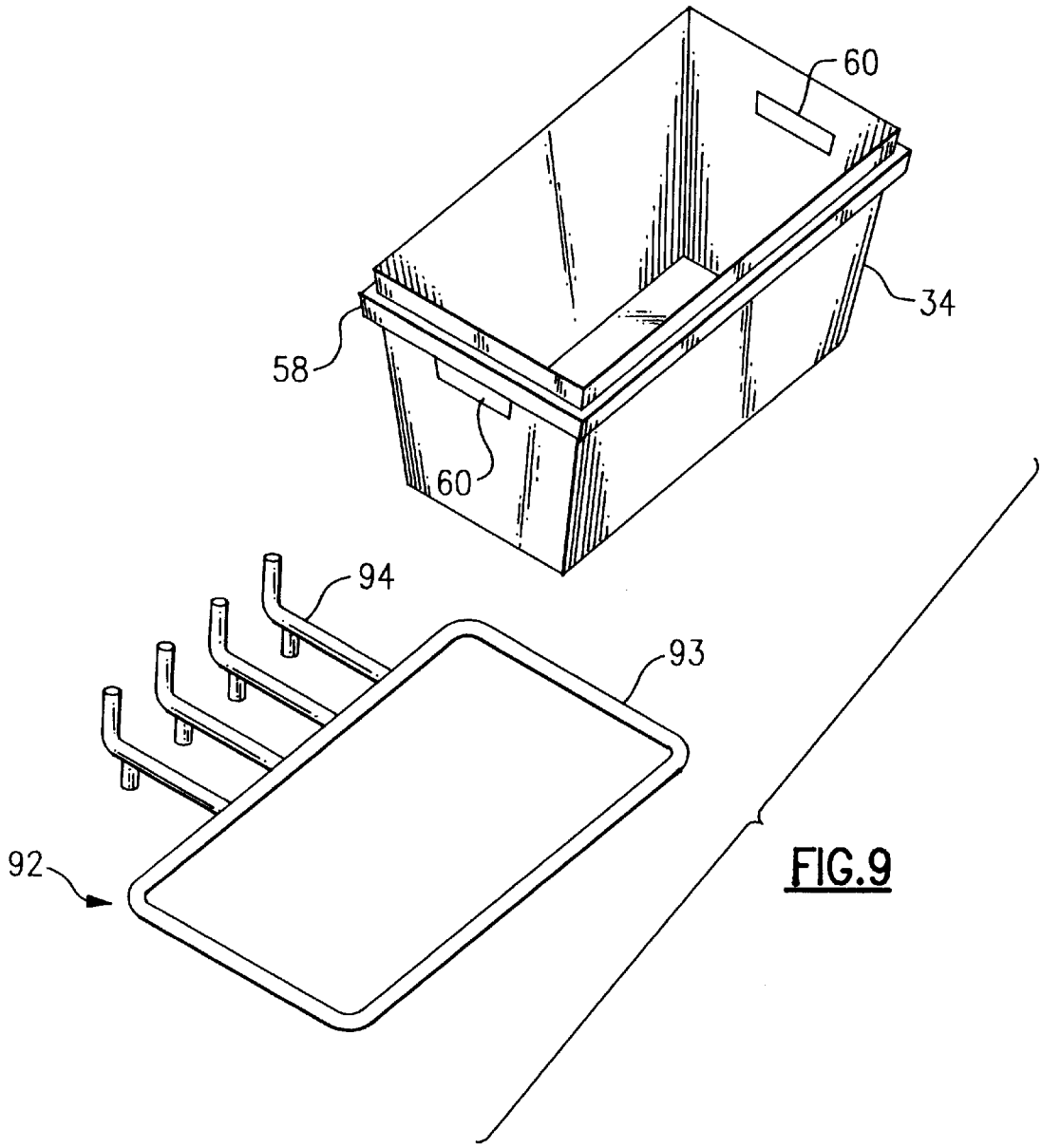
FIG. 9 is a perspective view showing a holder and container as employed in the embodiment of FIGS. 7 and 8.

Another embodiment of the invention is shown in FIGS. 7, 8, and 9. This embodiment is a corner or end floral display unit 80, seen from one side (FIG. 7) and from one end (FIG. 8). The unit 80 has a base 82 which contains the refrigeration and other mechanical equipment, and a tower 83 that rises from the base with a vertical side wall 84 and a vertical end wall 86. A top or cover 88 is situated at the top or the unit. In this embodiment, the walls 84 and 86 have an array of chilled air supply openings 90. Air is circulated from a return air grille (not shown) in the base 82, through an evaporator coil, into the tower 83, and the refrigerated air is supplied non-turbulently from the supply openings 90.

Here the wet-pack containers 34 are suspended on racks or hangers 92 that are placed on one or the other of the walls 84, 86. One suitable form of the hanger is shown in FIG. 9, in the form of an oblong frame (of metal or plastic) with a set of prongs 94 extending from one side. The prongs are dimensioned and spaced an amount to fit into the supply opening,s 90. The container 34 fits into the frame 93 with the flange 58 seated on the frame 93. In this embodiment the containers 34 tilt forward somewhat from the wall 84 or 86, for better display of the flowers to customers.

Instead of the hanger 92 shown here, other suitable shelving, racking, or attachment means can be employed to place the containers directly into the floral display unit without having to transfer the flowers to another container or a vase.

While the invention has been described here with reference to a preferred embodiment, the invention is not limited only to that embodiment. Rather, many modifications and variations will be apparent to those skilled in the art, without departing from the scope and spirit of this invention, as defined in the appended claims.

I claim:

1. Refrigerated display case for flowers and adapted to receive directly wet-pack upright floral shipping containers and without repacking the flowers into vases or other containers, comprising a cabinet having a back, sides and an open front display portion, the front display portion including a plurality of horizontal shelf members arranged in stair-step fashion, and a plurality of vertical riser walls disposed respectively behind said shelf members and between successive ones of said shelf members; and air cooling means within said cabinet for producing a continuous laminar flow of chilled air over said shelf members, including a return air intake disposed across said cabinet below a front of a lowermost one of said shelf members; chilling means for chilling air that enters said return air intake; a plurality of chilled air supply openings arranged across each of said vertical riser walls for discharging said chilled air in a laminar flow path over said shelves towards said return air intake; and means for moving air from said return air intake through said chilling means to said chilled air supply openings, wherein said means for moving air includes a cold air tunnel defined between said shelf members and a partition disposed beneath said shelf members such that air leaving said chilling means passes in contact with the underside of said shelf members, and wherein said shelf members have openings therethrough adapted for receiving said wet-pack floral shipping containers such that a lower portion of said said containers protrudes through the respective shelf member and is in contact with the air leaving said chilling means;

wherein said return air intake comprises a recess extending transversely below the front of said lowermost shelf member and having an undercut transverse wall, with a return air grille being disposed in said undercut transverse wall.

2. Refrigerated display case according to claim 1, wherein said shelf members each have a chamfered front portion and a flat portion therebehind, and said openings each extend from said flat portion onto said chamfered portion, so as to expose a forward wall of the associated container to facilitate placement and removal of the containers.

3. Refrigerated display case according to claim 2, wherein said containers have side walls and end walls, with hand hold cutouts formed in said side walls, and wherein said openings are oriented so that the containers have one of the end wall facing forward with said hand hold cutout above the associated chamfered front portion.

4. Refrigerated display case according to claim 3, wherein said openings are spaced at intervals such that side walls of adjacent containers substantially abut one another.

5. Refrigerated open display case according to claim 1, wherein said shelf member has a chamfered front portion, with said openings extending onto the chamfered front portion, so that an end wall of said container is accessible by hand above the front portion of the shelf member.

6. Refrigerated display case for flowers or other merchandise, with laminar flow boundary layer, comprising a cabinet having a back, sides and an open front display portion, the front display portion including at least one vertical wall disposed at a rear of said display portion;

air cooling means within said cabinet for producing a continuous laminar flow of chilled air out through an array of chilled air supply openings in said vertical wall, including a return air intake; chilling means for chilling air that enters said return air intake; said array of plurality of chilled air supply openings arranged across said vertical wall being operative to discharge said chilled air in a laminar flow path through said display portion towards said return air intake; and means for moving air from said return air intake through said chilling means to said chilled air supply openings; and a plurality of holders adapted to receive directly wet-pack upright floral shipping containers so that the flowers can be displayed therein in the cabinet display portion without repacking the flowers into vases, each of said holders having an aperture of oblong shape to match the shape of the wet-pack shipping container, and including means removably insertable into said chilled air supply openings in said vertical wall for suspending said holders on said vertical wall.

7. Refrigerated display case for flowers or other merchandise, with laminar flow boundary layer, comprising a cabinet having a back, sides and an open front display portion, the front display portion including at least one vertical wall disposed at a rear of said display portion;

air cooling means within said cabinet for producing a continuous laminar flow of chilled air out through an array of chilled air supply openings in said vertical wall, including a return air intake; chilling means for chilling air that enters said return air intake; said array of plurality of chilled air supply openings arranged across said vertical wall being operative to discharge said chilled air in a laminar flow path through said display portion towards said return air intake; and means for moving air from said return air intake through said chilling means to said chilled air supply openings; and a plurality of holders adapted to receive directly wet-pack upright floral shipping containers so that the flowers can be displayed therein in the cabinet display portion without repacking the flowers into vases, each of said holders having an aperture of oblong shape to match the shape of the wet-pack shipping container, and including means for suspending said holders on said vertical wall;

wherein said means for suspending includes an arrangement of one or more hooks adapted to penetrate said chilled air supply openings to suspend the associated holders from the vertical wall.

* * * * *